US006162304A

United States Patent [19]

Weidman et al.

[11] Patent Number: 6,162,304

[45] Date of Patent: Dec. 19, 2000

[54] CLEANING VAPOR COMPRESSION SYSTEMS

[75] Inventors: David Weidman; George McDonough, both of Mendham, N.J.; Raymond Thomas, Pendleton, N.Y.; Ian Shankland, Williamsville, N.Y.; Roy Robinson, Cheektowaga, N.Y.; Ellen Swan, Lancaster, N.Y.

[73] Assignee: AlliedSignal Inc., Morristown, N.J.

[21] Appl. No.: 09/208,384

[22] Filed: Dec. 9, 1998

Related U.S. Application Data

[62] Division of application No. 08/900,800, Jul. 25, 1997.

[51] Int. Cl.[7] ..... B08B 5/00; B08B 7/04

[52] U.S. Cl. ..... 134/12; 134/10; 134/11; 134/31; 134/40

[58] Field of Search ..... 510/108, 177, 510/411, 365, 256; 134/10, 11, 12, 31, 40, 42, 2; 252/67, 364, 194

[56] References Cited

U.S. PATENT DOCUMENTS

| | | | |
|---|---|---|---|
| 3,881,949 | 5/1975 | Brock | 134/11 |
| 5,108,637 | 4/1992 | Pearson | 252/67 |
| 5,174,906 | 12/1992 | Henry | 210/765 |
| 5,375,426 | 12/1994 | Burgener | 62/85 |
| 5,496,866 | 3/1996 | Sommerfeld et al. | 521/131 |
| 5,558,810 | 9/1996 | Minor et al. | 252/67 |
| 5,574,192 | 11/1996 | Van Der Puy et al. | 570/167 |
| 5,679,175 | 10/1997 | Hayes et al. | 134/26 |

FOREIGN PATENT DOCUMENTS

| | | | |
|---|---|---|---|
| 0431458 A1 | 12/1991 | European Pat. Off. | C23G 5/028 |
| 9535271 | 12/1995 | WIPO | C07C 19/08 |

*Primary Examiner*—Yogendra Gupta
*Assistant Examiner*—Gregory E. Webb
*Attorney, Agent, or Firm*—Colleen D. Szuch; Marie L. Collazo

[57] ABSTRACT

Cleaning a component of a vapor compression system with a cleaning composition having a hydrofluorocarbon as an active ingredient.

23 Claims, No Drawings

CLEANING VAPOR COMPRESSION SYSTEMS

This application is a division of pending U.S. patent application Ser. No. 08/900,800 filed Jul. 25, 1997.

FIELD OF INVENTION

The present invention relates to cleaning lubricated vapor compression systems. More specifically, this invention relates to removing lubricants from such systems by the use of a hydrofluorocarbon.

BACKGROUND OF THE INVENTION

There is a need to clean lubricated vapor compression systems and their components during manufacture and service.

Vapor compression systems are well known in the art. They are used in a wide variety of applications such as heating, air conditioning, and refrigeration. By compressing and expanding a heat transfer agent or refrigerant, these systems absorb and release heat according to the needs of a particular application. Common components of a vapor compression system include: vapor or gas compressors; liquid pumps; heat-transfer equipment such as gas coolers, intercoolers, aftercoolers, exchangers, economizers; vapor condensers, such as reciprocating piston compressors, rotating screw compressors, centrifugal compressors, and scroll compressors; evaporators; liquid coolers and receivers; expanders; control valves and pressure-drop throttling devices such as capillaries; refrigerant-mixture separating chambers; steam-mixing chambers; and connecting piping and insulation. These components are typically fabricated from copper, brass, steel and conventional gasket materials.

Since vapor compression systems have sliding, rotating or other moving components, most require the use of a lubricant which is mixed with the refrigerant. There is a need from time to time to clean such systems and their components by removing the lubricants from their surfaces. Such a need arises, for example, during the retrofit of a chlorofluorocarbon (CFC) or hydrochlorofluorocarbon (HCFC) refrigerant to a hydrofluorocarbon (HFC) refrigerant, and during service, especially after a catastrophic event such as compressor burnout. There is also a need to clean such systems during manufacture.

Until recently, chlorofluorocarbons (CFCs), such as trichloromethane (R-11), were used as cleaning agents for such systems. Although effective, CFCs are now considered environmentally unacceptable because they contribute to the depletion of the stratospheric ozone layer. As the use of CFCs is reduced and ultimately phased out, new cleaning agents are needed that not only perform well, but also pose no danger to the ozone layer.

A number of environmentally acceptable solvents have been proposed, but their use has been met with limited success. For example, organic solvents, such as hexane, have good cleaning properties and do not deplete the ozone layer, but they are flammable. Aqueous-based cleaning compositions have zero ozone depletion potential and are nonflammable, but they tend to be difficult to remove from the cleaned surfaces due to their relatively low volatility and the presence therein of additives that leave a residue. Additionally, aqueous-based cleaning compositions are often inadequate for cleaning typical organic soils that are present in vapor compression systems. Terpene-based solvents, like aqueous-based cleaning compositions, are difficult to remove from the system.

Therefore, a need exists for the identification of environmentally-acceptable cleaning agents that effectively clean vapor compression systems. The present invention fulfills this need.

DESCRIPTION OF THE INVENTION AND PREFERRED EMBODIMENTS

The present invention provides for the effective cleaning of lubricated vapor compression systems using a hydrofluorocarbon (HFC) while posing no risk to the ozone layer.

One aspect of the present invention relates to a cleaning composition comprising an HFC or a combination of HFCs. The applicants have found that HFC-based cleaning compositions have a number of attributes or properties that render them effective in cleaning vapor compression systems. First, a suitable HFC-based composition has adequate miscibility with commonly used lubricants, such as mineral oils, polyalkylene glycols, and polyol ester oils, to effect their removal from the surfaces that need to be cleaned. The term "adequate miscibility" as used herein refers to the composition's ability to interact with a lubricant to form a solution, emulsion, suspension, or mixture under normal cleaning conditions. Second, a suitable cleaning composition has a combination of properties that enables it to be easily and completely removed from the treated surface. To this end, it should evaporate readily using conventional techniques known in the art such as flushing the system with nitrogen or other inert gas, pulling a vacuum in the system, and/or heating the system. Third, a suitable cleaning composition has little or no flammability within the temperature ranges for which it is used. This means it should have no flash point up to its approximate boiling point. Fourth, it is compatible with all components and materials used in vapor compression systems including metals and sealants. And fifth, a suitable HFC composition poses no threat to the ozone layer.

In addition to these properties, a preferred cleaning composition has a volatility suitable for use in a vapor degreaser. That is, the volatility should be high enough such that the composition can be vaporized readily to produce a condensing vapor, but low enough such that the composition can be contained in a conventional open or closed degreaser. The more preferred embodiment of the composition has a volatility low enough such that the composition remains substantially a liquid at about room temperature.

A more preferred embodiment of the composition also has an atmospheric lifetime such that it contributes to neither smog nor the greenhouse effect. This means that the atmospheric lifetime should be long enough to allow it to escape from the lower to the upper atmosphere and avoid contributing to smog formation, but not be so long that it contributes to greenhouse warming. A preferred HFC should have an atmospheric lifetime of between about 1 and about 100 years, and preferably between about 1 and about 50 years, and more preferably between about 2 and about 15 years.

Suitable HFCs used in the cleaning composition include those, which, individually or in combination with other composition constituents, impart the aforementioned properties to the composition.

Among the more important properties imparted to the composition by the HFC is suitable volatility to evaporate readily and completely from the treated surface. Factors that affect evaporation include vapor pressure, the rate at which heat is applied, the heat conductivity of the liquid, specific heat of the liquid, latent heat of vaporization, surface tension, molecular weight, rate at which the vapor is removed, vapor density of the solvent, and humidity of the solvent (see B. P. Whim and P. G. Johnson, Directory of Solvents 34 (*Blackie Achedemic & Professional* (*an Imprint of Chapman and Hall*), 1996). The cooperation of these factors and their effect on evaporation tends to be complex, however, the following equation provides a simple relative measurement:

$$R_E=0.8217P_m\times(MW)^{1/2} \quad (1)$$

where $R_E$ is the evaporation index, and $P_m$ is the vapor pressure in mm of mercury at room temperature (J. John Stratta, Paul W. Dilion, Robert H. Semp, Tables of Solubility Parameters, Union Carbide Chemicals and Plastics, 50–647 *J. of Coatings Technology* 37–49 (Dec. 1978). The evaporation index is a relative measurement based on n-butyl acetate, wherein n-butyl acetate's index is 100. Exemplary evaporation indexes are provided for selected compounds in Table 1 below.

TABLE 1

Evaporation Indexes for Selected Compounds

| Compound | Evaporation Index |
|---|---|
| trichlorofluoromethane | 7732 |
| 1,1,2-trichlorotrifluoroethane | 3815 |
| 2,2-dichloro-1,1,1-trifluoroethane | 7052 |
| 1,1-dichloro-1-fluoroethane | 5337 |
| 1,1,1,3,3-pentafluoropropane | 10411 |
| 1,1,2,3-tetrafluoropropane | 3832 |
| 1,1,2,2,3-pentafluoropropane | 7230 |
| 1,1,1,2,3-pentafluoropropane | 7528 |
| Propane | 38927 |
| Water | 82 |

It has been found that a suitable HFC has an evaporation index of between about 1,000 and about 20,000. In a preferred embodiment, the evaporation index ranges from about 2,000 to about 11,000.

Another important attribute imparted to the composition by the HFC is non-flammability. As mentioned above, the composition should not have a flash point up to its approximate boiling point. To this end, a suitable HFC has a sufficient concentration of fluorine atoms such that the ratio of the atomic weight of all the fluorine atoms to the molecular weight (M.W.) of the total molecule is greater than about 0.65. Exemplary HFCs of this preferred embodiment include, for example, tetrafluoropropanes, pentafluoropropanes, hexafluoropropanes, hexafluorobutanes and heptafluorobutanes.

It is also preferable that the HFC include tetrafluoropropanes or pentafluoropropanes having at least one fluorine atom on each of their two terminal carbon atoms. Exemplary HFCs of this preferred embodiment include, for example, 1,1,2,2,3-pentafluoropropane (HFC-245ca), 1,1,2,3,3-pentafluoropropane (HFC-245ea), 1,1,1,2,3-pentafluoropropane (HFC-245eb), 1,1,1,3,3-pentafluoropropane (HFC-245fa), 1,1,3,3-tetrafluoropropane (HFC-2 54fa), and 1,1,1,3-tetrafluoropropane (HFC-254fb).

The more preferable HFCs include HFC-245ca, HFC-245ea, HFC-245eb, HFC-245fa, and HFC-254fb.

The HFC(s) can be produced using known equipment, methods and techniques. For example, a method of producing HFC-245fa is taught in U.S. Pat. No. 5,574,192. The process first involves reacting $CCl_4$ and vinyl chloride in the presence of a telomerization catalyst under conditions which produce a compound of the formula $CCl_3CH_2CHCl_2$. Next, this compound is reacted with hydrogen fluoride in the presence of a fluorination catalyst under conditions which produce HFC-245fa.

The cleaning composition of the present invention comprises a sufficient concentration of a suitable HFC, or combination of HFCs, to impart the aforementioned properties to the cleaning composition. For example, if the composition also comprises a flammable material, such as hexane, a sufficient amount of HFC should be present such that the composition has no flash point up to its approximate boiling point. One skilled in the art can readily determine the amount of HFC needed in the composition to achieve a combination of the aforementioned properties. Generally, the composition will contain from about 70% to about 100% by weight of HFC.

In addition to the HFC, the composition may comprise a secondary solvent for aid in dissolving the lubricants or other soils found in vapor compression systems. Such solvents are known in the art. In general, organic solvents, such as hydrocarbons, alcohols, esters and ketones, are preferred. Oxygen- or nitrogen-containing solvents are particularly well suited for dissolving polar materials such as solder flux, while hydrocarbons such as hexanes are well suited for dissolving mineral oil.

The amount of secondary solvent used should be sufficient to provide the composition with a desired solvency for a particular soil to be removed. One skilled in the art can determine readily this amount which generally will range from about 1% to about 30%, and more typically from about 1% to about 10% by weight of the composition.

The HFC-based cleaning composition can be used to clean a variety of types of lubricants used in vapor compression systems. Examples of widely used lubricants are polyalkylene glycols, polyol ester oils, and mineral oils. An example of a polyalkylene glycol oil is Pyroil RL244™ sold by Union Carbide for use with air conditioning systems. Mobil EAL22 sold by Castrol and Lubrikuhl 130 sold by Lubrizol are exemplary of ester oils. An example of a mineral oil is Ford YN-9, which is used in Ford automotive compressors, and BVM 100 oil, which is also used for automotive compressors. Mineral oils are typically used in CFC and HCFC compression systems, which, as discussed above, are being phased out.

In use, the cleaning composition of the present invention is first applied to the surface of a component of the lubricated vapor compression system. The application techniques are known in the art, and include exposing the composition, in either vapor or liquid form, to the component or system. Next, the cleaning composition is removed from the component or system by allowing it to vaporize. Allowing the composition to vaporize may involve passively waiting until the composition evaporates, or it may involve proactive steps to facilitate vaporization.

Generally, it is preferable to have a composition that remains a liquid at room temperature, but requires just a small change in conditions to vaporize. Techniques for facilitating vaporization are known in the art and include, for example, heating the composition, lowering pressure, driving the vapor/liquid equilibrium of the composition in favor of vaporizing by displacing its vapor with an inert gas or by otherwise providing an environment in which the cleaning composition vaporizes.

Suitable cleaning techniques include decreasing a particular component or flushing the system. Degreasing particular components can be performed in an open or closed degreasers. Such cleaning apparatus is well known in the art. An example of a suitable closed type degreasers is the Baron Blakeslee NZE machine (Chicago, Ill.). In a simple degreaser, the HFC cleaning composition is boiled in a vessel. A cooling coil is positioned above the vessel to condense the vapor of the HFC and other vaporized materials, if any. The soiled component is dipped into the boiling composition for a period of time, for example, about 1 minute, and then suspended in HFC vapor for a period of time, for example, about 1 minute. Alternatively, instead of exposing the component to the vapor, it may be sprayed with unused cleaning composition. Other variations of cleaning cycles that can be used with degreasers can be used in the practice of the present invention.

Like degreasing, various procedures used for flushing the compressor are well known in the art. Basically, the compressor if flushed by pumping the cleaning composition through the compressor or entire vapor compression system. After the compressor or system is flushed, the volatile cleaning composition can be removed from the compressor by blowing nitrogen gas, or other gas, through the compressor or by attaching a vacuum pump to the compressor and drawing a vacuum on the system. Other suitable cleaning procedures can also be used to contact the cleaning composition of the present invention with the surfaces to be cleaned.

The following examples are illustrative of the practice of the present invention.

EXAMPLES

Example 1

This example illustrates the miscibility of hydrofluorocarbons (HFC) with lubricants typically used in vapor compression systems. The miscibility of each of HFC-245fa, HFC-245ea, HFC-356mcfq, and HFC236ca was tested individually with each of the following lubricants: Ford YN-9; Pyroil; Mobil EAL22; and Lubrikuhl. This test was conducted by placing the lubricants and the hydrofluorocarbons in a vessel at room temperature and observing if the mixture has one phase or two phases. The results are shown in Table 2. The use of the term "miscible" in Table 2 means that the mixture of hydrofluorocarbon and lubricant was one phase.

TABLE 2

MISCIBILITY

| Lubricant | Solvent | Result |
|---|---|---|
| Ford YN-9 | HFC-245fa | Cloudy, 2 phases |
| Pyroil | HFC-245fa | Miscible |
| Mobil Eal22 | HFC-245fa | Miscible |
| Lubrikuhl | HFC-245fa | Miscible |
| Ford YN-9 | HFC-245ea | Cloudy, 2 phases |
| Pyroil | HFC-245ea | Miscible |
| Mobil Eal22 | HFC-245ea | Miscible |
| Lubrikuhl | HFC-245ea | Miscible |
| Ford YN-9 | HFC356mcfq | Cloudy, 2 phases |
| Pyroil | HFC356mcfq | Miscible |
| Mobil Eal22 | HFC356mcfq | Miscible |
| Lubrikuhl | HFC356mcfq | Miscible |
| Ford YN-9 | HFC-236ca | Cloudy, 2 phases |
| Pyroil | HFC-236ca | Miscible |
| Mobil Eal22 | HFC-236ca | Miscible |
| Lubrikuhl | HFC-236ca | Miscible |

The results of miscibility tests for HFCs and air conditioning lubricants indicate that the lubricants were at least partially miscible in all the HFCs tested. Furthermore, the complete miscibility of the HFC-245fa, HFC-245ea, HFC-356mcfq and HEC-236ca with the two ester lubricants, Lubrikuhl 130 and Mobil EAL22, and with the polyalkylene glycol, Pyroil shows their effectiveness as cleaning compositions for vapor compression systems.

Example 2

This example illustrates the cleaning of parts of an air conditioning system. Such cleaning may be required during assembly or service. Instead of using actual parts of an air condition system, stainless steel coupons were used. These coupons first were cleaned and weighed. The coupons were 7.6 cm long and 1.1 cm wide. In test #1, they were then dipped in a lubricant. In order to remove the lubricant from the surface of the coupon, a simple degreaser was used. Boiling HFC-245fa was contained in metal beaker of volume 1000 cc. Above the beaker, there was a cooling coil to condense the vapor of the HFC-245fa. After being dipped in the lubricant, the coupon was put into the boiling HFC-245fa for 1 minute and then suspended in HFC-245fa vapor for 1 minute. To expose the coupons to vapor, the coupons were held in the region of the cooling coil where the vapor was condensing. In test #2, the coupon was dipped into boiling HEC-245fa, and sprayed with clean HFC-245fa. The results of this test are shown in TABLE 3.

TABLE 3

| Lubricant | Castrol SW 32 | Mineral Oil | Lubrikuhl | Pyroil RL-244 |
|---|---|---|---|---|
| Weight (g) of clean coupon | 4.99535 | 5.03533 | 5.00839 | 4.89974 |
| Weight (g) of remaining lubricant after cleaning - Test 1 | 0.00066 | 0.0041 | 0.00008 | 0.00010 |
| Weight (g) of remaining lubricant after cleaning - Test 2 | 0.00009 | 0.00027 | 0.00007 | 0.00002 |

In all these tests, the coupons were satisfactorily cleaned by the HFC-245fa.

Example 3

This example illustrates the effectiveness of HFC as a cleaning composition for vapor compression systems. One test of the efficiency of a flushing fluid is to determine if the fluid can remove most of the oil from a compressor. A Harrison 100T air conditioning compressor was used in this test. The mineral oil was drained from the compressor and the compressor was washed with hexane. The compressor was then weighed and filled with 205 grams of mineral oil. The oil was drained from the compressor and the compressor was flushed with HFC-245fa. Gaseous nitrogen was then used to remove the volatile HEC-245fa from the compressor. The HFC-245fa vapor was trapped in a dry ice trap. When the compressor was weighed, it was found that it still contained 13 grams of mineral oil. This meant that 94% of the oil was removed by the procedure. A repeat of the procedure resulted in the removal of 93% of the remaining oil. These results confirm the ability of an HFC cleaning composition to perform as a flushing agent.

What is claimed is:

1. A method for cleaning a component of a vapor compression system comprising the steps of:

flushing the component with a cleaning composition comprising a pentafluoropropane; and allowing the cleaning composition to evaporate from the component.

2. The method of claim 1, wherein the cleaning composition is non-flammable up to its approximate boiling point.

3. The method of claim 2, wherein the ratio of the atomic weight of all the fluorine atoms in the pentafluoropropane to the molecular weight of the pentafluoropropane is greater than about 0.65.

4. The method of claim 3, wherein the evaporation index for the pentafluoropropane ranges from about 1,000 to about 20,000.

5. The method of claim 4, wherein the composition has a boiling point such that it remains substantially a liquid at about room temperature.

6. The method of claim 1, wherein the evaporation index for the pentafluoropropane ranges from about 1,000 to about 20,000.

7. The method of claim 1, wherein the pentafluoropropane is selected from the group consisting of 1,1,2,2,3-pentafluoropropane, 1,1,2,3,3-pentafluoropropane, 1,1,1,2,3-pentafluoropropane, and 1,1,1,3,3-pentafluoropropane.

8. The method of claim 1, wherein the pentafluoropropane is 1,1,2,2,3-pentafluoropropane.

9. The method of claim 1 wherein the pentafluoropropane is 1,1,2,3,3-pentafluoropropane.

10. The method of claim 1 wherein the pentafluoropropane is 1,1,1,3,3-pentafluoropropane.

11. The method of claim 1, wherein the composition further comprises a secondary solvent.

12. The method of claim 1, further comprising substantially removing a lubricant from the component.

13. The method of claim 12, wherein the lubricant is selected from the group consisting of polyalkylene glycol, polyol ester, mineral oil and combinations of two or more thereof.

14. The method of claim 1, wherein the cleaning composition is vaporized by flushing the component with an inert gas.

15. The method of claim 1, wherein the cleaning composition is vaporized by applying a vacuum to the component.

16. The method of claim 1, further comprising applying the cleaning composition to the component using a degreaser.

17. A method for cleaning a component of a vapor compression system, comprising the steps of:

flushing the component with a cleaning composition comprising 11,1,3,3-pentafluoropropane; and allowing the cleaning composition to evaporate from the component.

18. The method of claim 17, wherein the cleaning composition is non-flammable up to its approximate boiling point.

19. The method of claim 18, wherein the composition has a boiling point such that it remains substantially a liquid at about room temperature.

20. The method of claim 17, wherein the cleaning composition further comprises a secondary solvent.

21. The method of claim 17, further comprising substantially removing a lubricant from the component.

22. The method of claim 21, wherein the lubricant is selected from the group consisting of polyalkylene glycol, polyol ester, mineral oil, and combinations of two or more thereof.

23. The method of claim 17, further comprising applying the cleaning composition to the component using a degreaser.

* * * * *